US007104852B1

(12) United States Patent
Tsui

(10) Patent No.: US 7,104,852 B1
(45) Date of Patent: Sep. 12, 2006

(54) WATER CRAFT APPARATUS

(76) Inventor: Kaiyuen Francis Tsui, D2, 6/F, Greenside Villa, 77 Bluepool Road, Happy Valley (HK)

( * ) Notice: Subject to any disclaimer, the term of this patent is extended or adjusted under 35 U.S.C. 154(b) by 0 days.

(21) Appl. No.: 11/234,744

(22) Filed: Sep. 22, 2005

(51) Int. Cl.
*B63H 16/20* (2006.01)

(52) U.S. Cl. ..... 440/29; 114/61.1

(58) Field of Classification Search ..... 440/21, 440/29; 114/61.1, 345
See application file for complete search history.

(56) References Cited

U.S. PATENT DOCUMENTS 3,809,003 A 5/1974 Foldvari
3,965,843 A 6/1976 Smith
4,128,073 A 12/1978 Rossmann
6,595,813 B1 * 7/2003 Lekhtman ..... 440/21

FOREIGN PATENT DOCUMENTS

FR 2557784 A1 7/1985
FR 2740424 A1 4/1997
WO WO 1993/019979 A1 10/1993

* cited by examiner

*Primary Examiner*—Lars A. Olson
(74) *Attorney, Agent, or Firm*—Jones Day

(57) ABSTRACT

A water craft includes a first portion having a front end, a rear end, and at least two sides; a second portion connected to the rear end of the first portion, wherein the second portion includes a walking-exercise treadmill portion having an exercise platform and at least two propelling portions on either side of the exercise platform; third and fourth portions that include at least two laterally spaced, parallel air tanks or pontoons; and a handle connected to a front end of the first portion and used as a controller for the walking exercise treadmill portion and a steering unit of the water craft.

15 Claims, 8 Drawing Sheets

WATER CRAFT APPARATUS

TECHNICAL FIELD

The present invention is related to Water Sports Craft, especially to "walk-on-water" type of apparatus.

BACKGROUND OF INVENTION

The inventors of the subject matter of this application have invented a water craft apparatus for use at home or on the beach that can be transformed into a chair, jogging machine, water ski, water bed and potentially other shapes for specific use by a person.

U.S. Pat. No. 4,128,073 discloses a Water Sports Craft designed for water sports as running over the water, as exercise, for use in competitive games, or for just having fun in the water. In addition, U.S. Pat. No. 3,809,003 discloses a mechanically-propelled Water Craft having a mechanically propelled mechanism operated by a person walking or running on an endless belt. Moreover, WO93/019979 discloses an apparatus for use in water-skiing/cross-country skiing and surfing.

SUMMARY OF INVENTION

An object of an embodiment of the present invention is a multipurpose water craft in the form of a folding chair. A notable feature of an embodiment of the present invention is the use of a treadmill, a handle and a pair of rolling paddles installed at both sides of the chair. One can move the chair by walking on the treadmill, which gives the paddles a forward rolling motion. By steering the tiller in the form of a handle which is equipped with a rudder at the end, one can go in any direction.

Another object of an embodiment of the present invention is to provide a "walk-on-water" type of equipment which includes a first portion A having a front end, a rear end, and at least two sides; a second portion connected to the rear end of the first portion A, wherein the second portion comprises a walking exercise treadmill portion with an exercise platform EP and at least two propelling portions PP1 and PP2 situated adjacent to a side of said first portion; and third and fourth portions C and D comprising two laterally spaced, parallel air tanks or pontoons, wherein a handle is connected to the front end of the first portion A and is used as both a control means for the walking exercise treadmill portion and a steering means for the "walk-on-water" equipment.

Each of the air tanks or pontoons are formed by two telescopic parts, wherein the fifth and sixth portions E and F are fixed on either side of the first portion A such that the third and fourth portions C, D are connected to either side of the first portion A via the fifth and sixth portions E, F for the transformation or folding into other shapes. The two telescopic parts are each formed by an inner part extruded from an outer part. The outer parts each have a groove for receiving and fixing a rotatable L-shaped arm AR formed on the fifth or sixth portions. This allows the apparatus to be folded into at least one of following shapes: a chair, a jogging machine, a water ski or water bed.

The handle H is connected with a rudder RU protruding downwards out of the first portion A. The rudder RU is formed by a pair of plates which can be manually changed from a flat shape to a V-shape and turn according to the rotation of the handle H. The inclination or length of the handle H can be adjusted when a knob KB is pressed. A speed reducer is located near the propulsion means, a pressure (at different levels) can be applied on it to reduce the speed.

This comprises the means for controlling the running direction and speed of propulsion. The handle further comprises a lighting device at its free end.

To make it more versatile and adaptable for people of different needs, it is also equipped with the following features:

For use at home:

It can be used as a regular chair at home.

When the chair cover is removed and the chair unfolded, it can be transformed into a treadmill for use as a jogging machine.

A handle is attached to the seat of the chair. After being lifted up and bent backwards, it can be used to do sit-up exercises.

For use at the beach:

An umbrella can be installed at the top of the handle to shade the sun.

When unfolded, it can be used as a floating bed at sea.

A lamp is installed at the front of the handle so people can use it in the dark.

With the aid of the handle, one can stand steadily on the chair to and use the water craft as a water ski.

It can also be used effectively as life-saving equipment (at home or at the beach).

The embodiments of present invention can therefore be used in a number of situations. It is envisaged that manufacturers of both trades (furniture and sports) would have a potential interest in the production of embodiments of the present invention.

The chair is preferably made of durable material such as hard plastic and a soft cover having different designs for comfortable use. Therefore, it has a large potential market in hotel/sports/domestic areas.

The design of the water sports craft apparatus is based on Archimedes' principle of water displacement of an object, i.e., the buoyancy (uplift force) of an object when submerged in water is equal to the weight of the total volume of water displaced. The chair preferably is capable of supporting a person up to 200 lbs on a treadmill and could carry a maximum of 2 persons of average weight, each weighing approximately 150 lbs each. Including the dead weight of the instrument, the total dead+live load of the chair is estimated to be around 500 lbs, and the design carrying capacity is preferably around 1,000 lbs, with a safety factor of 2. Therefore, the buoyancy of the chair is designed to displace at least 1,000 lbs or 16 cubic feet of water (so that, in a critical case, the chair is half-submerged in water). It is noted, of course, that someone of ordinary skill in the art will readily appreciate that the design of the water sports craft of the present invention may be changed without deviating from the scope of the present invention to increase the buoyancy of the apparatus.

A known in the art gear and pulley connection system is included in the design of the water sports craft of the present invention to enable the backward motion (while walking on the treadmill) to change to a forward motion (for the paddles to row on water). The handle is an essential accessory and must be strong enough to provide stability for people to hold on to while walking on the treadmill. All moveable parts are preferably made of water resistant materials.

For indoor use, the maximum load comes from a 200 lb person jogging on the treadmill. The chair is preferably strong enough to sustain this dynamic loading. The material and its thickness to be selected shall satisfy this requirement.

BRIEF DESCRIPTION OF DRAWINGS

A preferred embodiment of the present invention is described below with reference to the accompanying drawings in which.

DETAILED DESCRIPTION OF THE INVENTION

Figure 1:
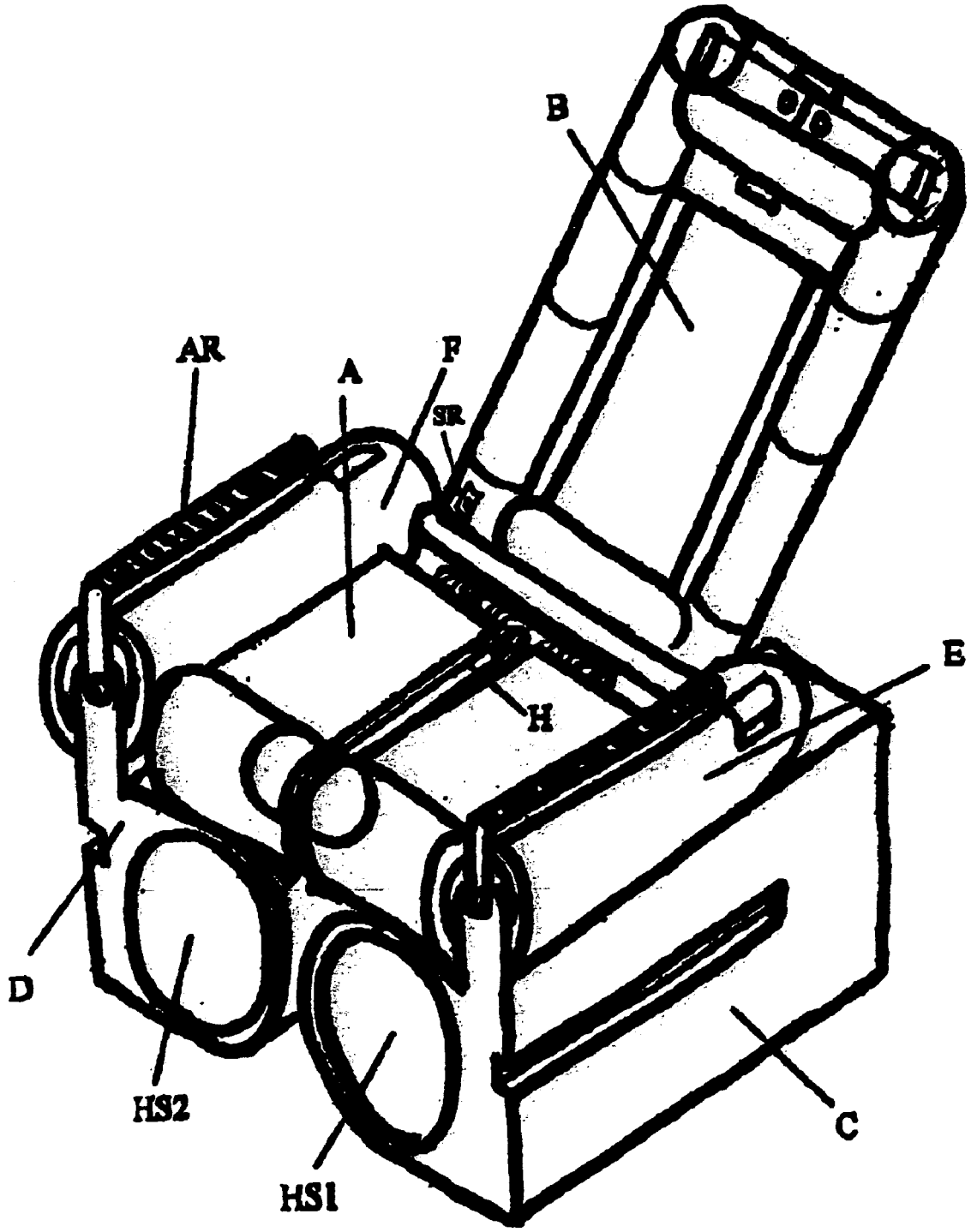
FIG. 1 is a perspective view of the present invention in the form of a chair.

In FIG. 1, the present invention is folded as a chair. The chair includes, among other things, a first portion A used as a seat for the chair; a second portion B preferably tilt-hinged connected to the seat and used as a backrest for the chair; and third and fourth portions C and D preferably hinge-connected to either side of the first portion A via fifth and sixth portions E and F and used as a pair of legs positioned under the seat. The fifth and sixth portions E and F each preferably have a cylindrical shape with a rotatable L-shaped arm AR such that the third and fourth portions C and D can be transformed or folded into other shapes. The second portion B can be used as a jogging or walking exercise treadmill portion when tilted downwards as shown in FIG. 3, which will be described later. Cushions (not shown) are preferably placed on the seat and backrest for comfort. In the seat, there is an indentation for receiving a T-shaped handle H so preferably no part of the handle protrudes above the upper surface of the seat. The backrest B also comprises a tubular portion PP1 or PP2 on either side that work as a propelling portion in FIG. 2.

Figure 2:
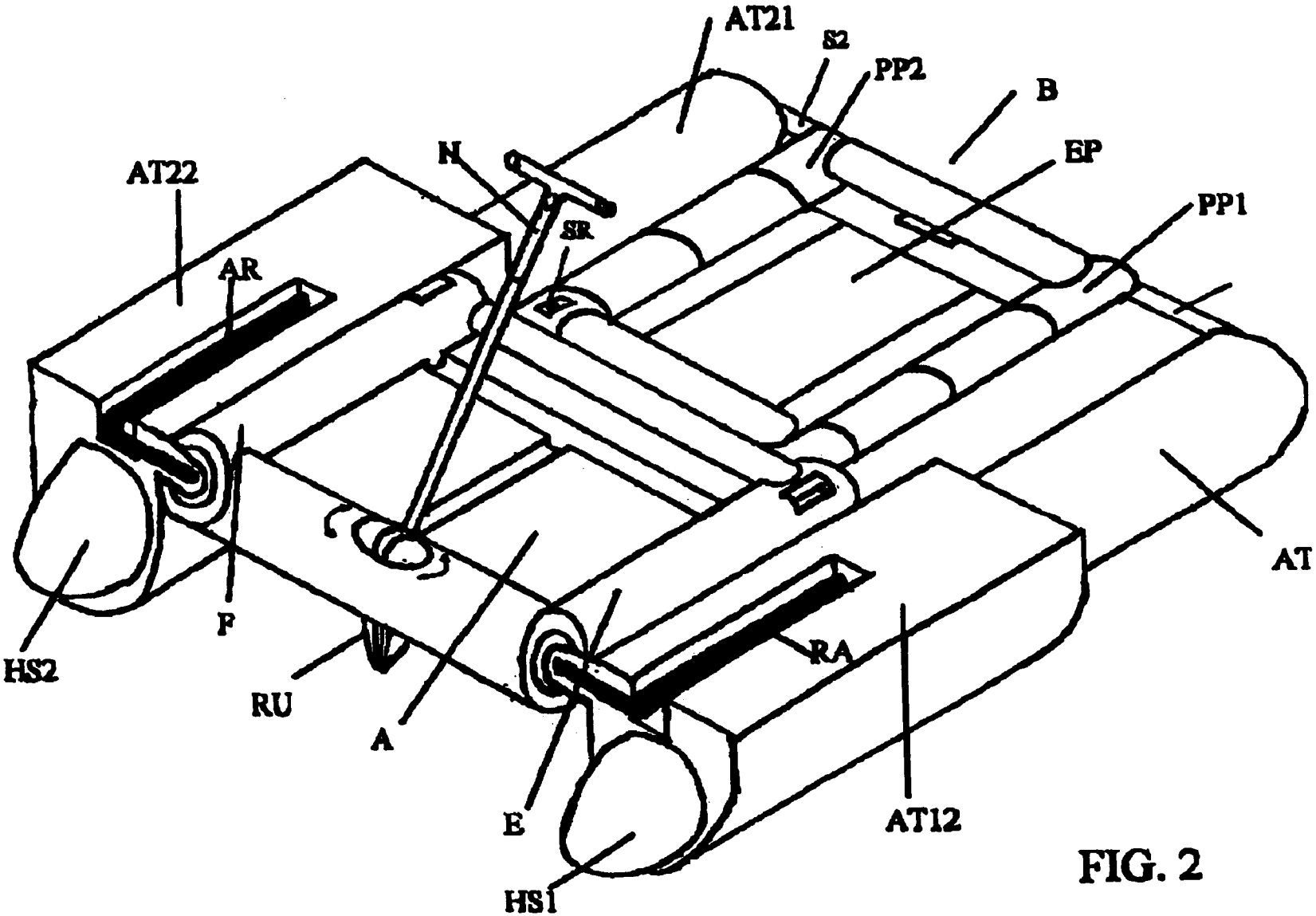
FIG. 2 is a perspective view of the present invention in the form of a mechanically-propelled watercraft.
Figure 3:
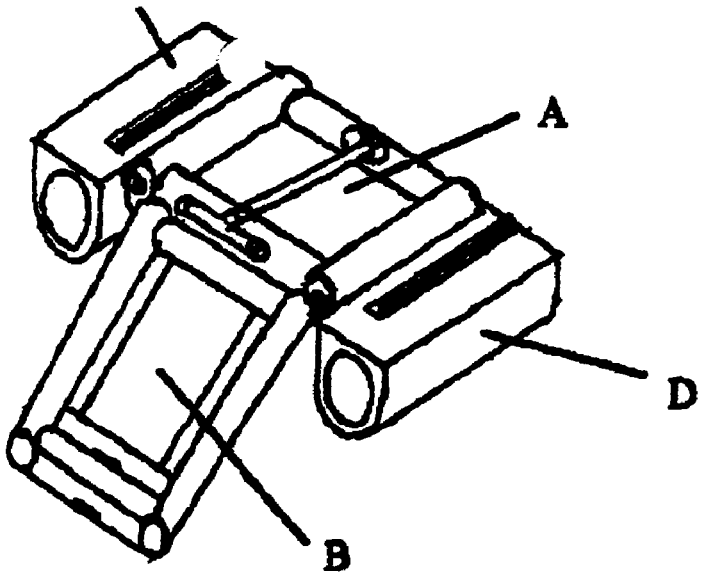
FIG. 3 is a perspective view of the present invention in the form of a jogging machine.

Referring now to FIG. 2, the present invention is unfolded as a mechanically-propelled watercraft in the form of a "walk-on-water" machine. The second portion B is lowered horizontally with the first portion A. The third and fourth portions C and D are shown in FIG. 2 working as two laterally spaced, parallel air tanks or pontoons, each preferably having two telescopic parts, i.e., an inner part AT11 and AT21 extrudes on an outer part AT12 and AT22. The outer part AT12 and AT22 have grooves for receiving and fixing a pair of L-shaped arms AR and RA. Therefore, two laterally spaced, parallel air tanks or pontoons are re-positioned on the outside of the fifth and sixth portions E and F as well as the second portion B. The second portion B has an exercise platform EP, and two propelling portions PP1 and PP2 positioned between the exercise platform EP and inner parts AT11 and AT21 respectively. These provide the propulsion means PM (see FIGS. 9 and 10) positioned inside the propelling portion.

Figure 8:
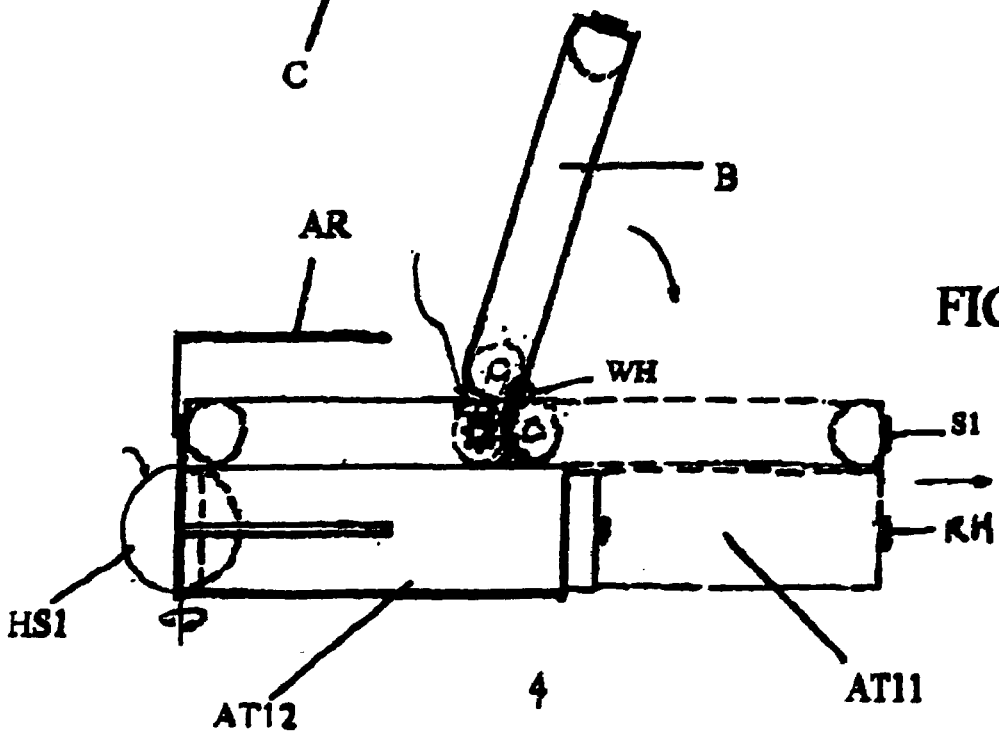
FIG. 8 is a view of FIG. 7 showing the transformation into a water bed as shown in FIG. 5.
Figure 15:
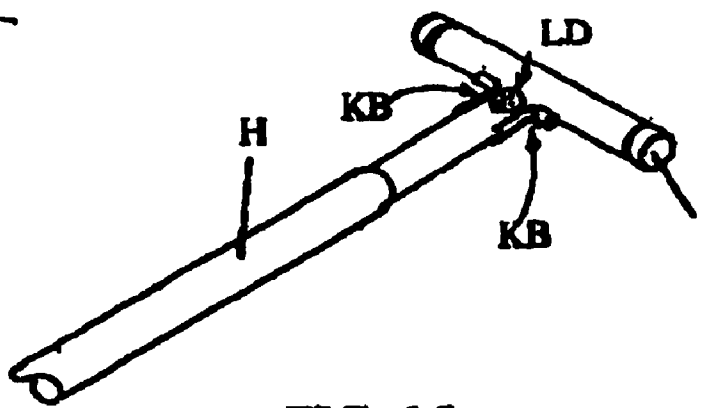
FIG. 15 is a partial perspective view of the handle in FIG. 2.
Figure 13:
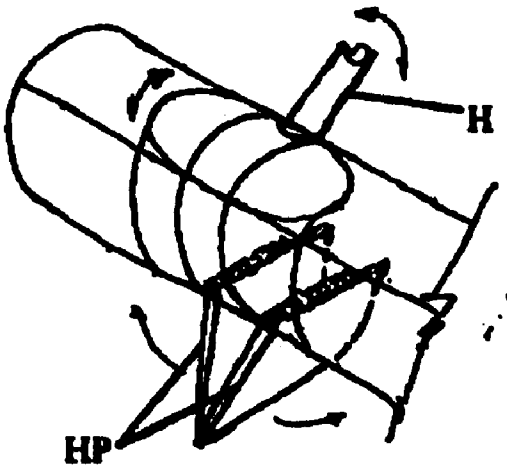
FIG. 13 is a partial view of the rudder in FIG. 2.

At the end of the "walk-on-water" machine, at least one water exit WE (see FIG. 11) is provided. There are two stiffeners S1 and S2 provided above the exit. When rotated outward by 180 degrees, the holes on the stiffeners receive the round head RH (shown in FIG. 8) provided at the end of the inner parts AT11 and AT21. This can provide additional buoyancy to the second portion B (see FIGS. 2 and 8). The first portion A is at the front of the "walk-on-water" machine with the handle H tilted at an angle and working as a steering mechanism. As shown in FIGS. 2 and 13, the handle is connected with a rudder RU which protrudes downward when the handle is rotated. The rudder RU is preferably formed by a pair of hinged plates HP (see FIG. 13) which can be manually changed from a flat shape to a V-shape and turned according to the rotation of the handle. The handle can have a telescopic form, which is pulled in order to extend. As shown in FIG. 15, the upper end of the handle H is T-shaped with two arms and a long leg. A lamp or lighting device LD is preferably positioned at the junction of the leg and the arms. A battery (not shown) can be inserted by opening one end cap CP of the arms. Moreover, knobs KB can provide means for extending the handle and rotating the handle forward or backward.

Figure 9:
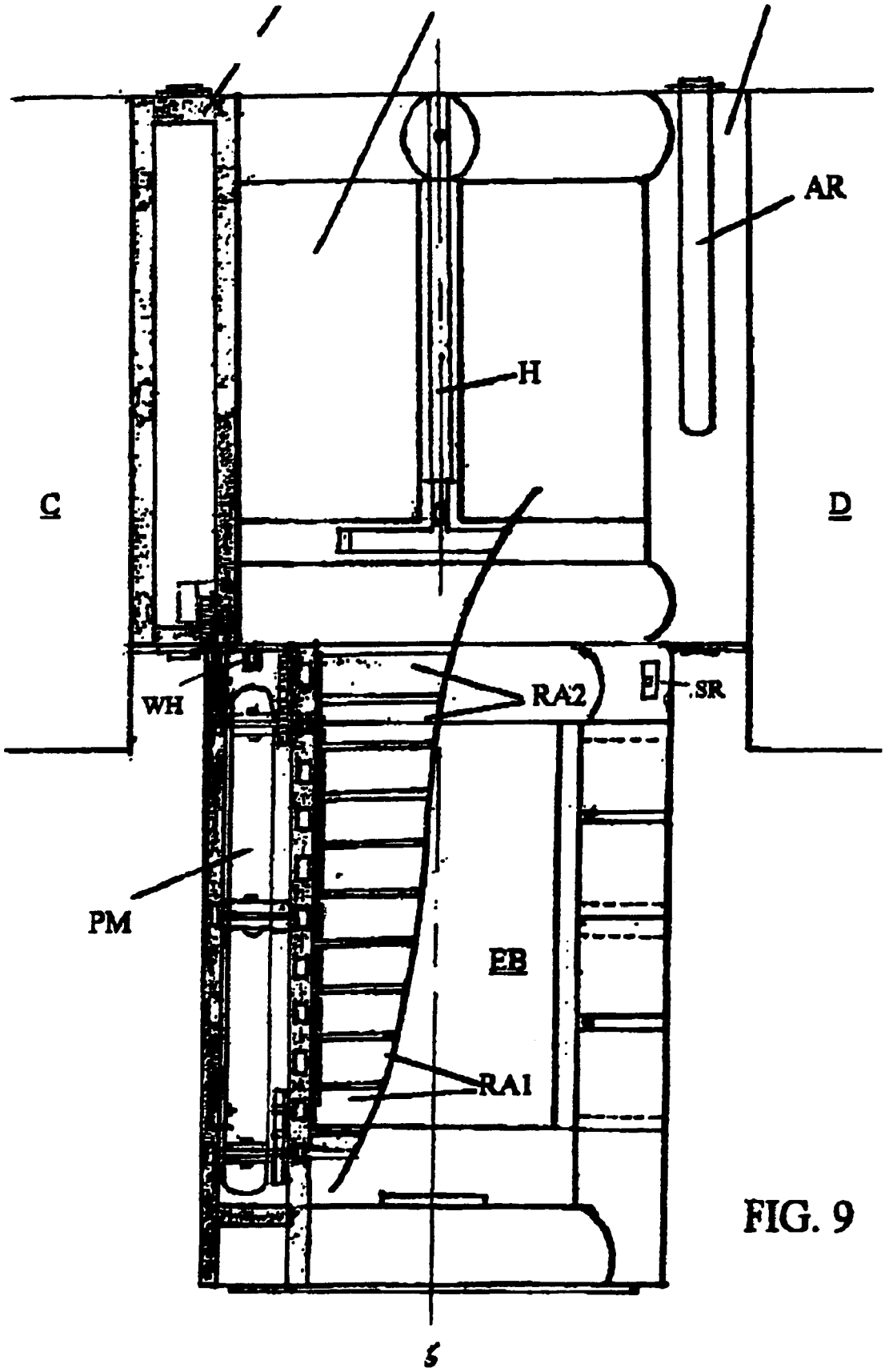
FIG. 9 is a partly-sectioned top view of a walking exercise treadmill portion shown in FIG. 2.
Figures 10, 10A:
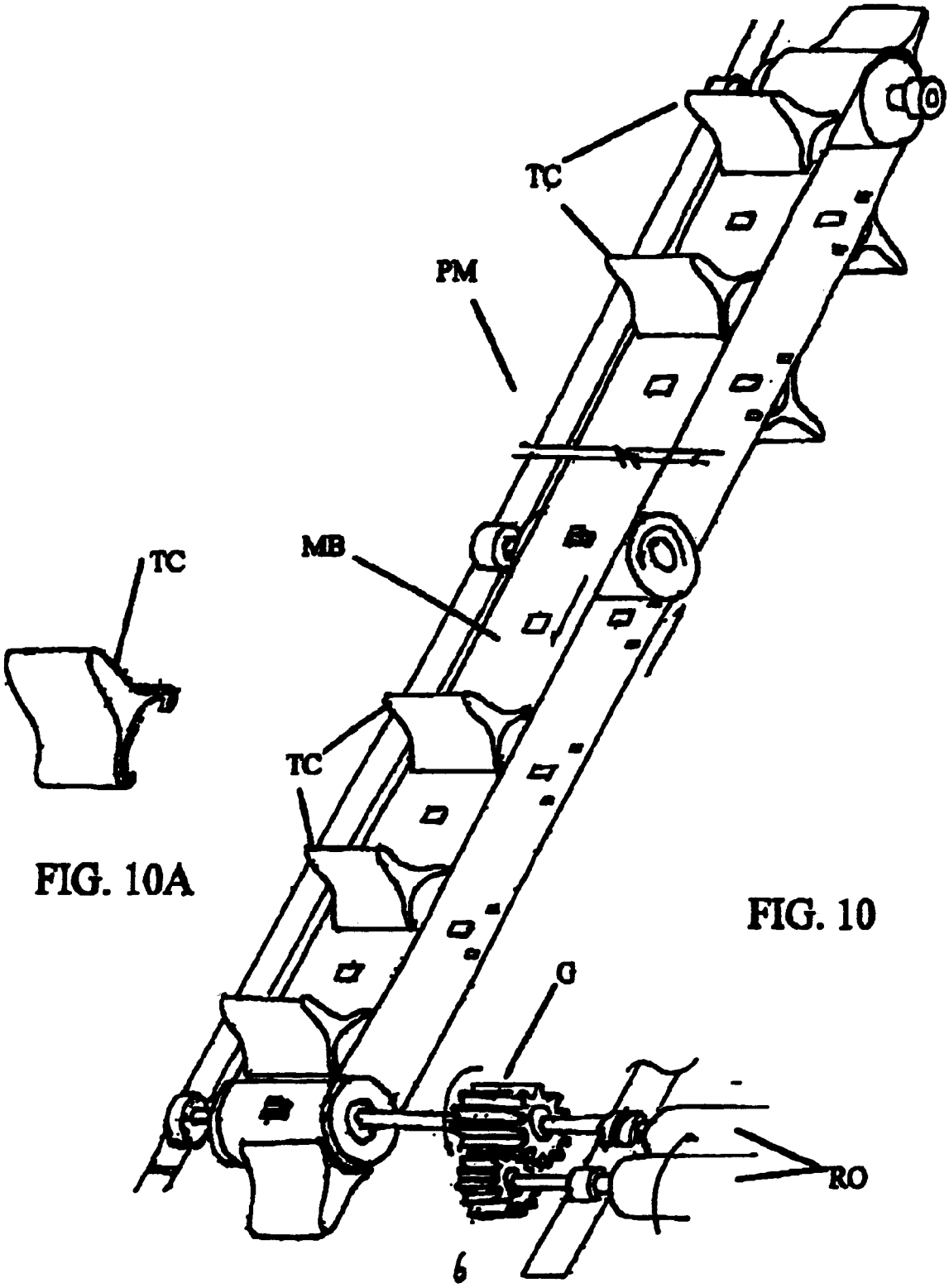
FIG. 10 is a perspective view of propulsion means.
FIG. 10A is perspective view of a cleat in FIG. 10.

As shown in FIG. 9, the exercise platform EP includes an elongated frame with first and second roller assemblies RA1 and RA2 mounted across opposite lateral ends of the frame. An endless belt EB is mounted for travel about the roller assemblies. The belt EB is flexible for supporting the weight of the user. A speed reducer SR is provided at the preferably hinged-end of the second portion B near the roller assembly RA2. When it is compressed, it provides a pressure (at different levels) to the gear and reduces the speed of the rollers.

The propulsion means PM (see FIG. 10) comprises movable endless belts MB formed of a suitable flexible water resistant material such as rubber or rubberized fabric. Each belt has on its outer surface transverse cleats TC that are preferably evenly spaced along the length of the endless belt MB. The cleats TC serve as vanes or paddles when immersed in water. At least one of the rollers RO of the exercise platform EP is selectively coupled (such as gearing G) to the propulsion means PM so that the running direction of propulsion means can be alternated (i.e., forewards or backwards). The cleats TC (see FIG. 10A) can be detachably mounted on the belt MB to facilitate replacement.

FIG. 3 shows an embodiment of the present invention in the form of a jogging machine (indoor). As shown on the right side of FIG. 6, the apparatus can be transformed from FIG. 1 by rotating the legs as shown in FIG. 2 (third and fourth portions C and D) outward by 90 degrees and rotating the arm rests AR 90 degrees such that they are received and fixed in grooves of the legs. Moreover, as shown in FIG. 7, the backrest is lowered by the upper end to touch the floor and used as a jogging or walking exercise treadmill portion.

Figure 4:
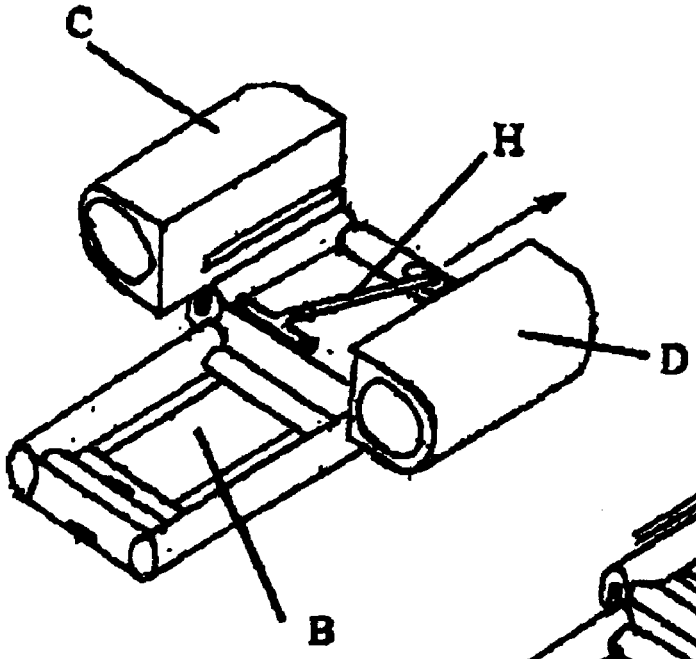
FIG. 4 is a perspective view of the present invention in the form of a water ski.

If the legs (formed by third and fourth portions C and D) are rotated outward by an additional 90 degrees (see left side of FIG. 6), an embodiment of the present invention forms a water ski as shown in FIG. 4. The lower end of the handle can be tied by a rope to a boat.

Figure 5:
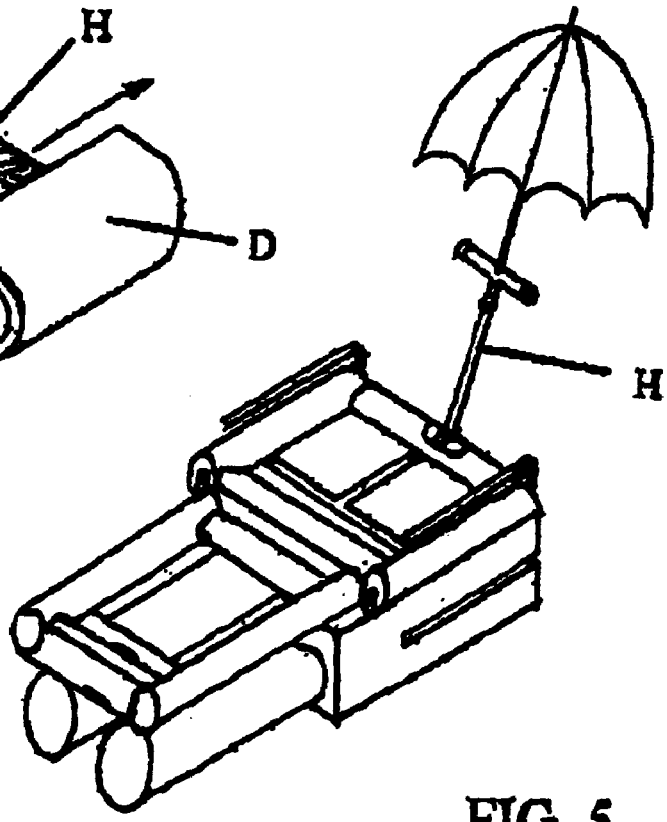
FIG. 5 is a perspective view of the present invention in the form of a water bed (float)

FIG. 5 shows an embodiment of the present invention in the form of a water bed for use at sea or on the beach. It can be transformed from FIG. 1 by the inner parts AT11 and AT21, which extrude on the outer parts AT12 and AT22, and the back rest is lowered such that it is laid horizontally above the inner parts AT11 and AT21 (see FIG. 8). The handle H is tilted upward. To provide shade, an umbrella is fixed/mounted at the upper end of the handle. On the other end (opposite to the end which inner parts AT11 and AT21 extrude) of the outer parts AT12 and AT22, a (hollow) half-hemisphere HS1 or HS2 is rotated about a vertical axis such that the half hemisphere protrudes outside to reduce water resistance (see FIG. 2). A pair of wheels WH are provided adjacent to the roller assembly RA2 location as a means for easier carriage (see FIGS. 8 and 9).

Figure 14:
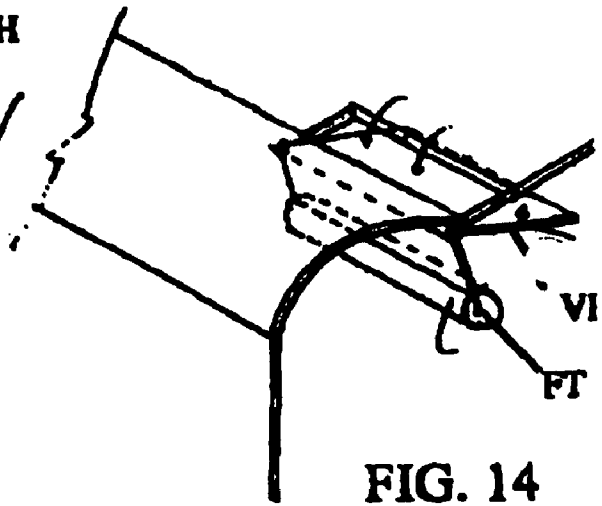
FIG. 14 is a perspective sectional view along X—X in FIG. 11.
Figure 11:
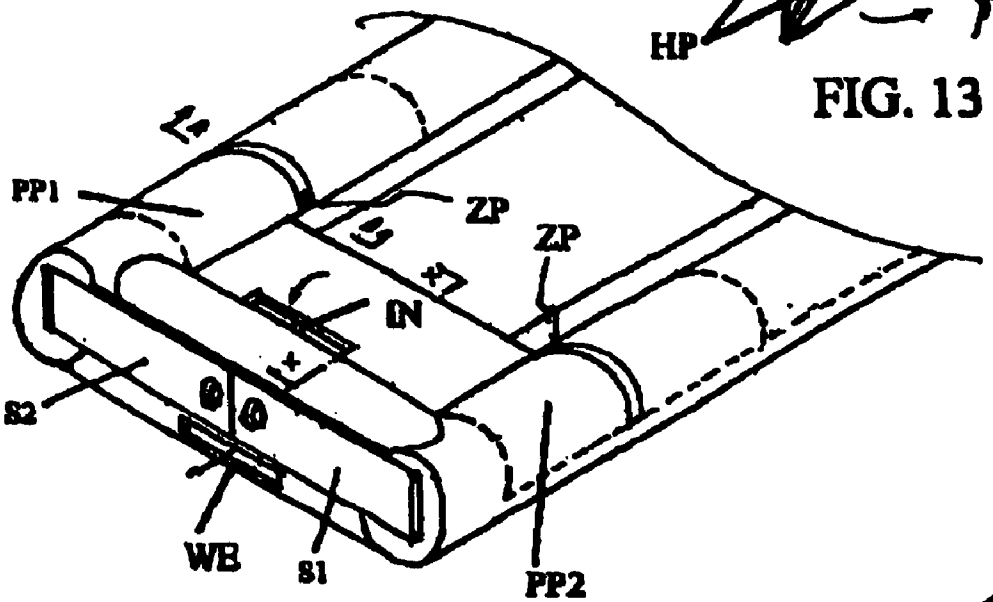
FIG. 11 is a partial perspective view of the backrest.

FIG. 11 shows at the rear end of the "walk-on-water" machine that a surface water one-way inlet IN is provided. As shown in FIG. 14, the inlet is closed by one side of V-plate VP and a float FT at the free end of the other lower side of V-plate such that the inlet is naturally closed by the float if water inside reaches a predetermined level. A similar device is also provided at the outlet WE to prevent excessive water from going inside the machine causing the inlet to be constantly closed.

Figure 12:
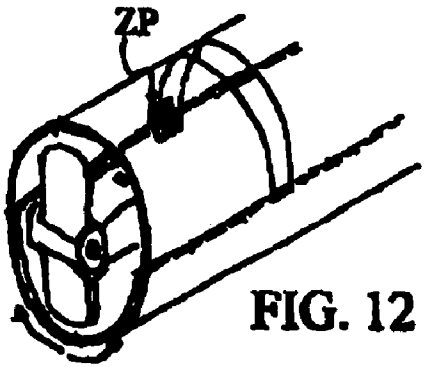
FIG. 12 is a perspective sectional view along A—A in FIG. 11.

Zippers ZP (see FIGS. 11 and 12) are positioned in the middle of each of the propelling portions such that the top part can be closed or opened for water-ski and "walk-on-water" functions respectively as well as for inspection and repair.

To make the embodiments of the present invention light in weight, all the parts should preferably be hollowed and an inflatable tire or airbag may be added therein.

The dimensions and buoyancy of various parts of a preferred embodiment of the "walk-on-water" equipment as shown in FIG. 2 is as follows:

| Parts | Length (ft) | Radius (ft) | Width (ft) | Thickness (ft) | Vol. (ft3) | Density (lbs/ft3) | Uplift (lbs) |
|---|---|---|---|---|---|---|---|
| Inner part (left) AT11 | 2.5 | 0.5 | 3.14 | — | 1.96 | 62.4 | 123 |
| Inner part (right) AT21 | 2.5 | 0.5 | 3.14 | — | 1.96 | 62.4 | 123 |
| Exercise platform EP | 3 | — | 1.5 | 0.5 | 2.25 | 62.4 | 140 |
| Propelling portion (left) PP1 | 3 | 0.25 | 3.14 | — | 0.59 | 62.4 | 37 |
| Propelling portion (right) PP2 | 3 | 0.25 | 3.14 | — | 0.59 | 62.4 | 37 |
| Sub-buoyancy of the "walk-on-water" (rear) = 459 lbs | | | | | | | |
| Outer part AT12 | 2.5 | — | 1.08 | 0.75 | 2.03 | 62.4 | 127 |
| Hemisphere HS1 | 2.5 | 0.5 | 3.14 | — | 0.98 | 62.4 | 61 |
| Outer part AT22 | 2.5 | — | 1.08 | 0.75 | 2.03 | 62.4 | 127 |
| Hemisphere HS2 | 2.5 | 0.5 | 3.14 | — | 0.98 | 62.4 | 61 |
| First portion A | 2 | — | 2 | 0.5 | 2.00 | 62.4 | 125 |
| Fifth portion E | 2 | 0.25 | 3.14 | — | 0.39 | 62.4 | 25 |
| Sixth portion F | 2 | 0.25 | 3.14 | — | 0.39 | 62.4 | 25 |
| Sub-buoyancy of the "walk-on-water" (front) = 550 lbs | | | | | | | |
| Total volume of water displaced = 16.17 ft3 | | | | | | | |
| Total buoyancy of the "walk-on-water" (front + rear) = 1009 lbs | | | | | | | |

Figures 16, 16A:
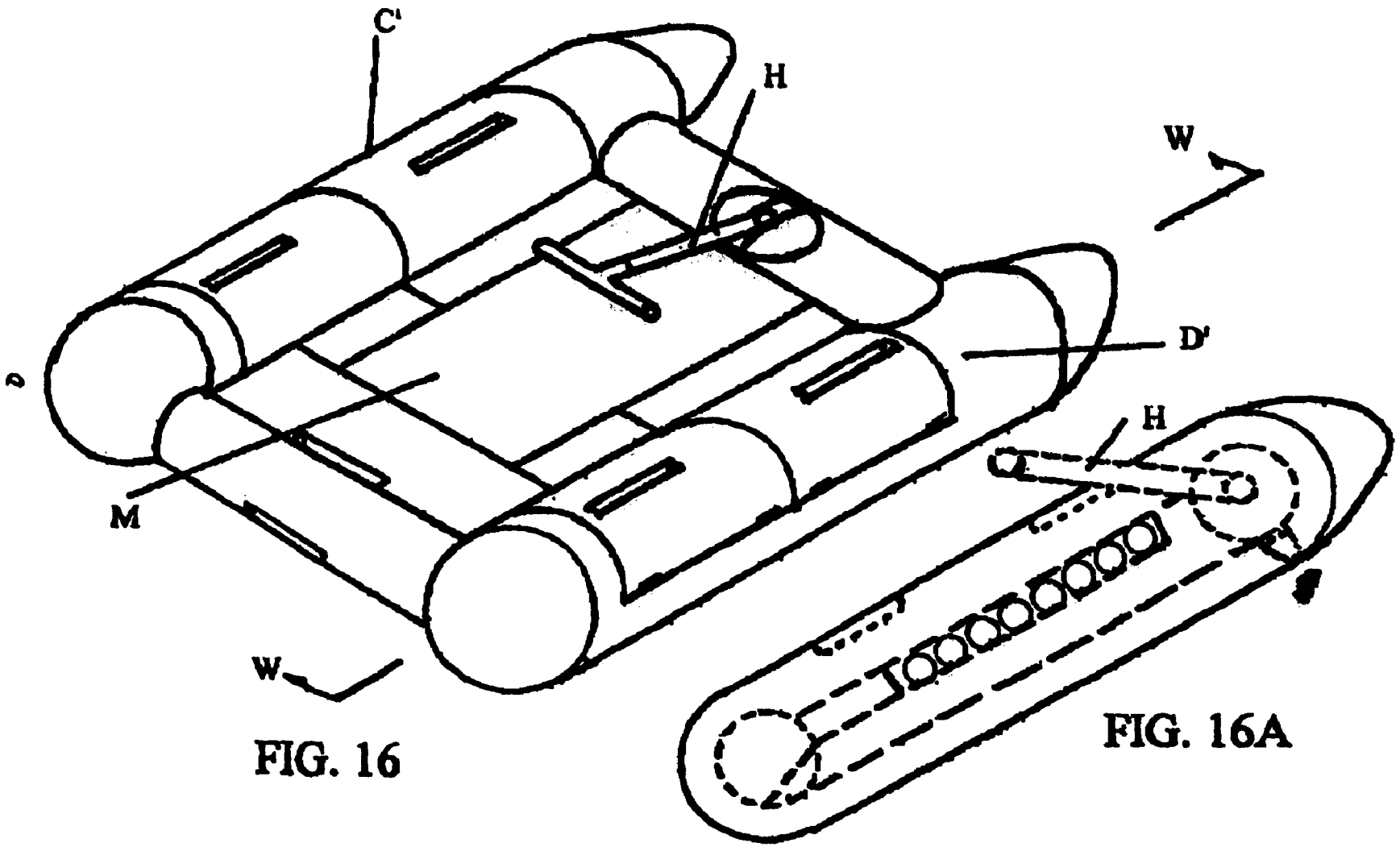
FIG. 16 is an alternative embodiment of the present invention.
FIG. 16A is a sectional view along W—W in FIG. 2.
Figure 3:
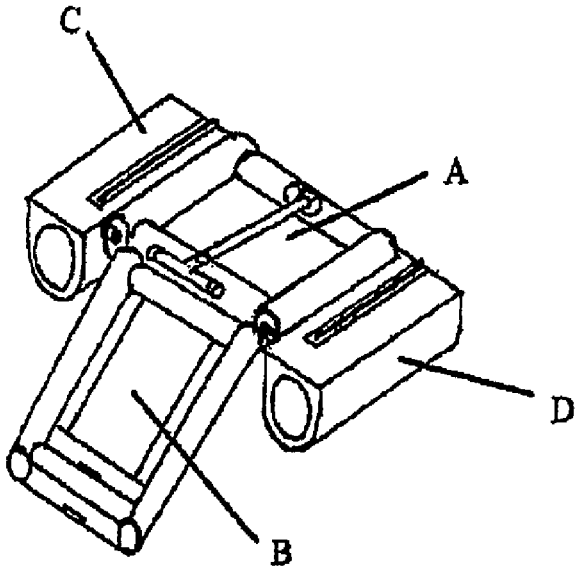
Figure 4:
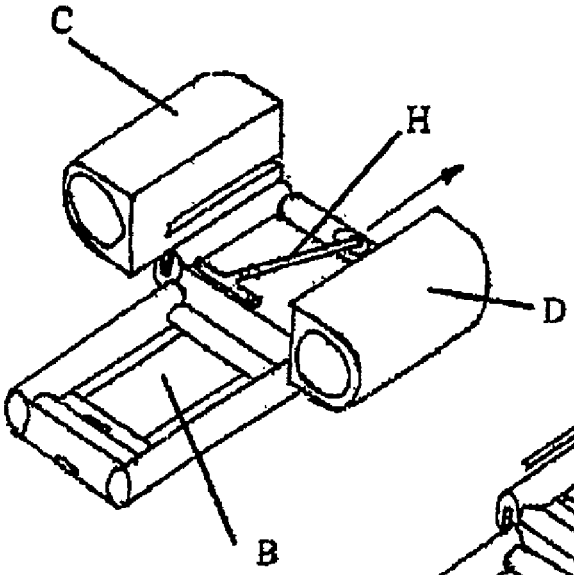
Figure 5:
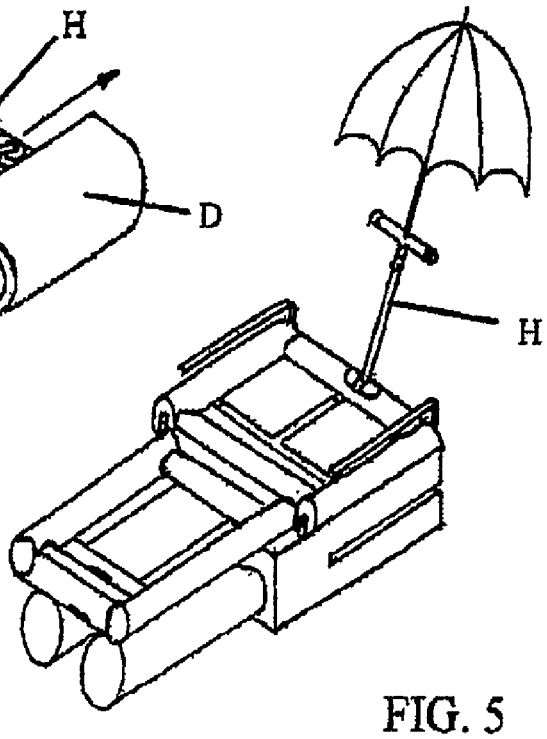
Figure 6:
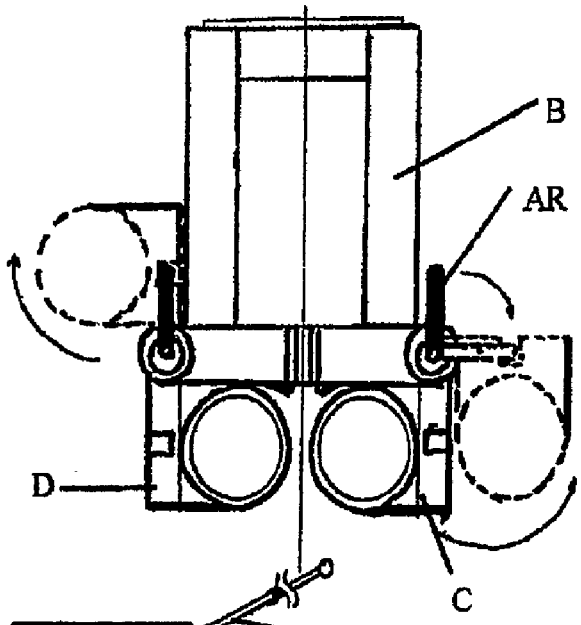
Figure 7:
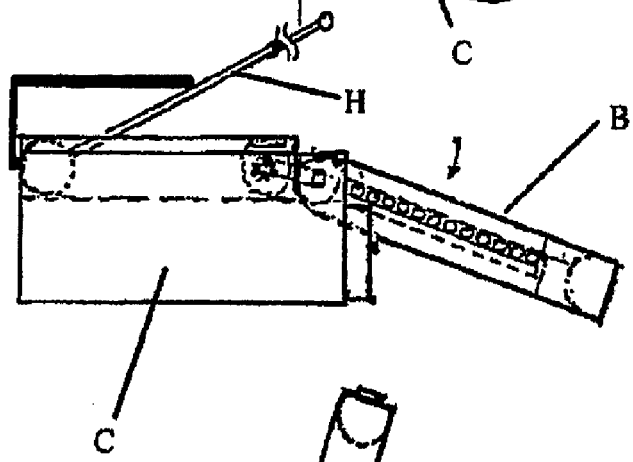
Figure 8:
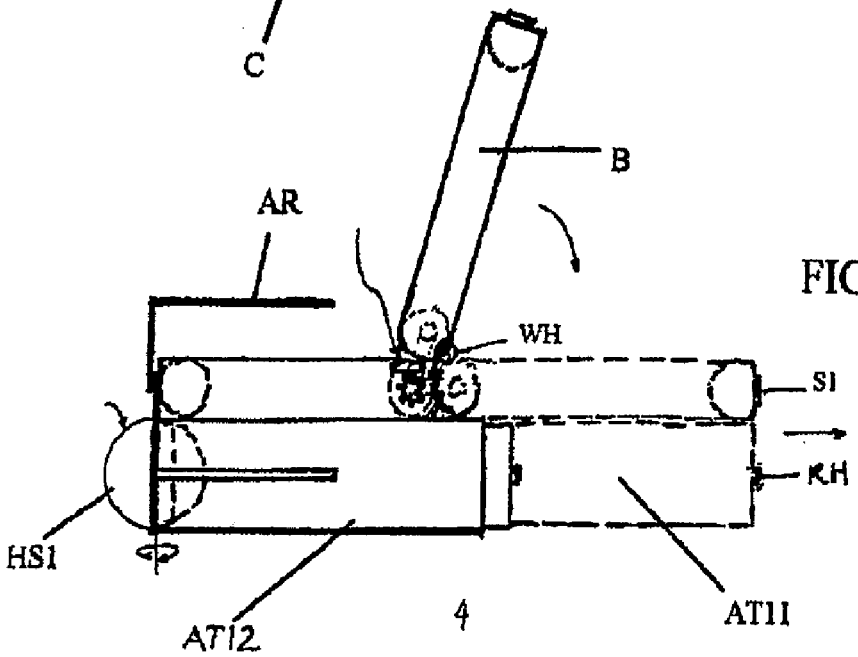
Figure 9:
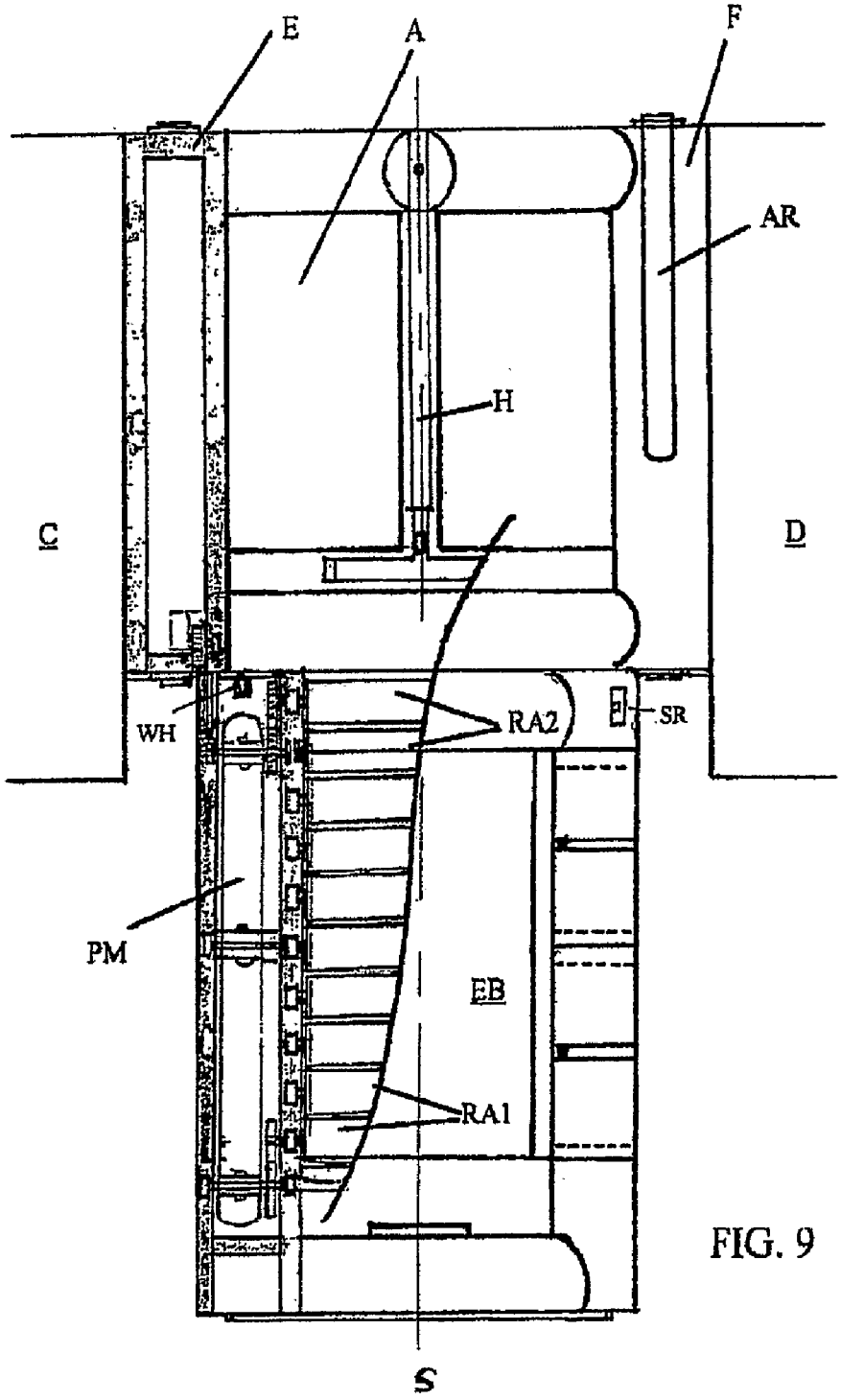
Figure 11:
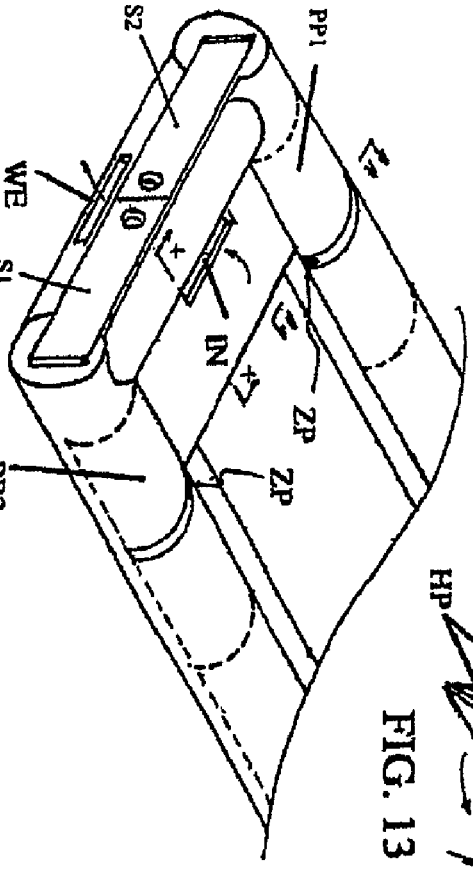
Figure 12:
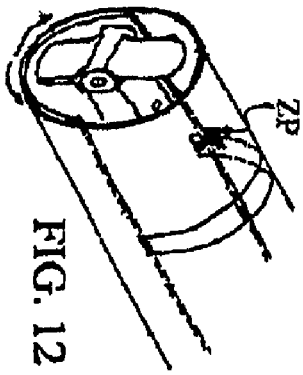
Figure 13:
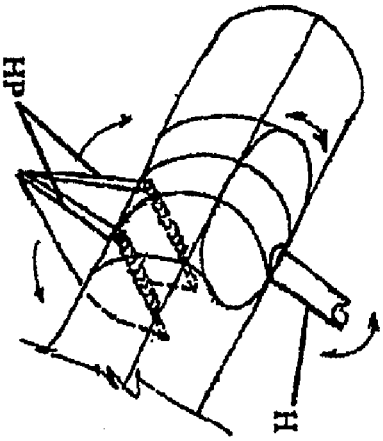
Figure 14:
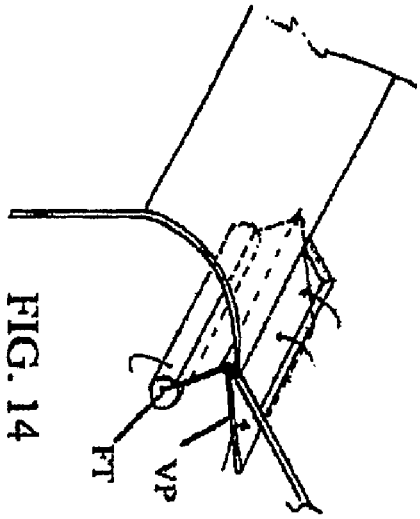
Figure 15:
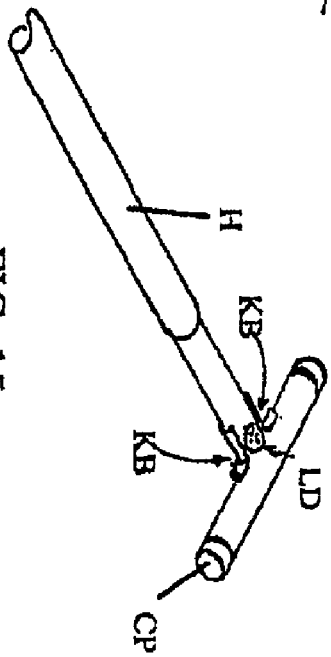

FIG. 16 shows an alternative embodiment of the present invention, for outdoor use. It is a simplified non-foldable version, where the fifth and sixth portions E and F are absent. The first portion A and second portion B are united as a flat middle portion M with the walking-exercise treadmill portion at the rear portion and the handle H at the front end. The third and fourth portions C' and D' are fixed on either side of the middle portion, each being formed as two laterally spaced, parallel air tanks or pontoons with propulsion means (not shown) inside. The third and fourth portions C' and D' can be opened at the top for inspection/repair of the propulsion means.

The dimensions and buoyancy of several parts of the embodiment of the "walk-on-water" equipment as shown in FIG. 16 is as follows:

| Parts | Length (ft) | Radius (ft) | Width (ft) | Thickness (ft) | Vol. (ft3) | Density (lbs/ft3) | Uplift (lbs) |
|---|---|---|---|---|---|---|---|
| Third portion C' | 5 | 0.5 | 3.14 | — | 3.93 | 62.4 | 245 |
| Fourth portion D' | 5 | 0.5 | 3.14 | — | 3.93 | 62.4 | 245 |
| Middle portion M | 5 | — | 2.50 | 0.5 | 6.25 | 62.4 | 390 |
| Total volume of water displaced = 14.11 ft3 | | | | | | | |
| Total buoyancy of the "walk-on-water" apparatus = 880 lbs | | | | | | | |

Another embodiment of the present invention utilizes a combination of a treadmill, a handle and rolling paddles built-in the form of a chair, which can be transformed into a water craft apparatus, so that people can use it to "walk on water". Such an embodiment of the present invention can be modified in part or whole with the use of similar/different forms and sizes of materials to achieve the same/similar purposes.

The embodiments of the present invention as described above may be carried out in specific ways other than those described above without departing from the spirit and essential characteristics of the present invention. The embodiments described above are therefore to be considered in all respects as illustrative and not restrictive, and all changes coming within the meaning and equivalency range of the appended claims are intended to be embraced therein.

What is claimed is:

1. A water craft comprising:

a first portion having a front end, a rear end, and at least two sides;

a second portion connected to the rear end of said first portion, wherein said second portion comprises a walking exercise treadmill portion having an exercise platform and at least two propelling portions, wherein each of the at least two propelling portions are situated adjacent to a side of said first portion;

third and fourth portions comprising at least two laterally spaced, parallel air tanks or pontoons; and a handle connected to the front end of said first portion.

2. The water craft according to claim 1, wherein each of the air tanks or pontoons are formed by at least two telescopic parts.

3. The water craft according to claim 1, further comprising fifth and sixth portions fixed on either side of said first portion such that said third and fourth portions are connected to either side of said first portion via said fifth and sixth portions, for transformation of said water craft into other shapes.

4. The water craft according to claim 2, wherein the at least two telescopic parts are each formed by an inner part extruded from an outer part, the outer part having a groove formed therein.

5. The water craft according to claim 3, wherein the other shapes comprise a chair, a jogging machine, a water ski and a water bed.

6. The water craft according to claim 1, wherein said handle is connected to a rudder protruding downwards from said first portion, the rudder being formed by at least a pair of plates that are capable of being manually changed from a flat shape to V-shape and turn according to the rotation of the handle, the inclination or length of the handle capable of being adjusted when a knob is pressed.

7. The water craft according to claim 1, wherein the handle comprises a means for controlling the running direction of propulsion.

8. The water craft according to claim 1, wherein the handle further comprises a lighting device secured to a free end of the handle.

9. The water craft according to claim 1, wherein the handle includes a means for mounting an umbrella.

10. The water craft according to claim 4, wherein a half-hemisphere is rotatably mounted on an end of each of the outer parts such that the half-hemisphere is capable of being rotated about a vertical axis.

11. The water craft according to claim 1, wherein at least two stiffeners are provided above a water exit at an end of each of the at least two propelling portions, wherein, when each of the at least two stiffeners are rotated outward, holes on the stiffeners are capable of receiving a head provided at an end of each of the inner parts.

12. The water craft according to claim 1, wherein said second portion includes a speed reducer as a means for controlling the speed of propulsion.

13. The water craft according to claim 1, wherein said second portion includes a pair of wheels for easier carriage.

14. A water craft comprising:

a first portion having a front end, a rear end, and at least two sides;

a second portion connected to the rear end of said first portion, wherein said second portion comprises a walking exercise treadmill portion having an exercise platform and at least two propelling portions, wherein each of the at least two propelling portions are situated adjacent to a side of said first portion;

third and fourth portions comprising at least two laterally spaced, parallel air tanks or pontoons;

a handle connected to the front end of said first portion; and fifth and sixth portions fixed on either side of said first portion such that said third and fourth portions are connected to either side of said first portion via said fifth and sixth portions, for transformation of said water craft into other shapes.

15. A water craft comprising:

a first portion having a front end, a rear end, and at least two sides;

a second portion connected to the rear end of said first portion, wherein said second portion comprises a walking exercise treadmill portion having an exercise platform and at least two propelling portions, wherein each of the at least two propelling portions are situated adjacent to a side of said first portion;

third and fourth portions comprising at least two laterally spaced, parallel air tanks or pontoons;

a handle connected to the front end of said first portion; and fifth and sixth portions fixed on either side of said first portion such that said third and fourth portions are connected to either side of said first portion via said fifth and sixth portions, for transformation of said water craft into other shapes, wherein at least two telescopic parts are each formed by an inner part extruded from an outer part, the outer part having a groove formed therein.

* * * * *

UNITED STATES PATENT AND TRADEMARK OFFICE

CERTIFICATE OF CORRECTION

PATENT NO. : 7,104,852 B1
APPLICATION NO. : 11/234744
DATED : September 12, 2006
INVENTOR(S) : Kaiyuen Frances Tsui It is certified that error appears in the above-identified patent and that said Letters Patent is hereby corrected as shown below:

Figure 3: Please correct reference numeral as indicated in attached drawing sheet.

Figure 6:
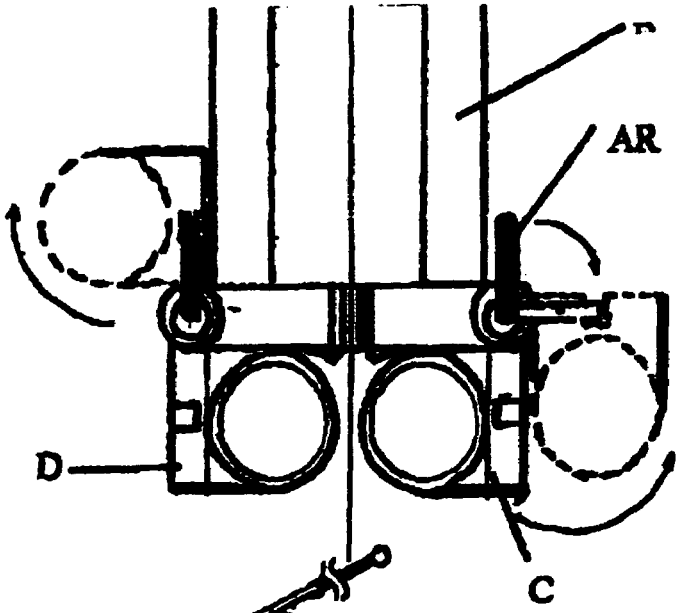
FIG. 6 is a front view of the present invention showing a portion in the transformation from FIGS. 1 to 4.
Figure 7:
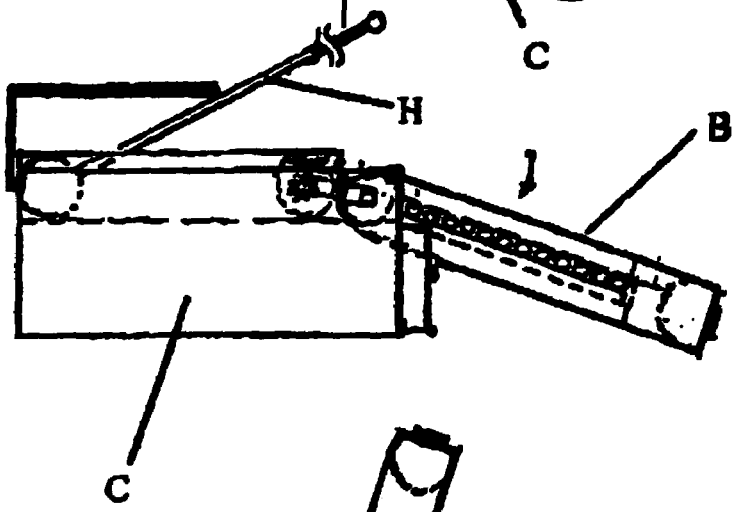
FIG. 7 is a side view of FIG. 3.

Figure 6: Please correct reference numeral as indicated in attached drawing sheet.

Figure 9: Please correct reference numeral as indicated in attached drawing sheet.

Figure 14: Please correct reference numeral as indicated in attached drawing sheet.

Figure 15: Please correct reference numeral as indicated in attached drawing sheet.

Signed and Sealed this

Sixteenth Day of October, 2007

JON W. DUDAS
*Director of the United States Patent and Trademark Office*